US005619832A

United States Patent [19]

Myrvold

[11] Patent Number: 5,619,832

[45] Date of Patent: Apr. 15, 1997

[54] ARRANGEMENT IN A PROTECTIVE MEMBRANE, ESPECIALLY FOR FLOORS

[75] Inventor: Egil Myrvold, Oslo, Norway

[73] Assignee: Isola AS, Notodden, Norway

[21] Appl. No.: 244,328

[22] PCT Filed: Aug. 16, 1993

[86] PCT No.: PCT/NO93/00125

§ 371 Date: May 23, 1994

§ 102(e) Date: May 23, 1994

[87] PCT Pub. No.: WO94/06977

PCT Pub. Date: Mar. 31, 1994

[30] Foreign Application Priority Data

Sep. 23, 1992 [NO] Norway ..... 923693
Feb. 4, 1993 [NO] Norway ..... 930392

[51] Int. Cl.[6] ..... E04F 15/16; B32B 3/00; B32B 3/28

[52] U.S. Cl. ..... 52/403.1; 52/480; 52/630; 428/116; 428/141; 428/174; 428/180

[58] Field of Search ..... 52/403.1, 480, 52/630, 798.1; 428/98, 116, 119, 141, 174, 179, 180, 187

[56] References Cited

U.S. PATENT DOCUMENTS

| | | | |
|---|---|---|---|
| 3,197,358 | 7/1965 | Angioletti et al. | 52/403.1 X |
| 3,834,487 | 9/1974 | Hale | 428/116 X |
| 3,888,087 | 6/1975 | Bergsland . | |
| 4,022,596 | 5/1977 | Pedersen | 428/116 X |
| 4,923,733 | 5/1990 | Herbst | 428/174 X |
| 4,945,697 | 8/1990 | Ott et al. | 52/403.1 |
| 5,044,891 | 9/1991 | Johnsen . | |
| 5,052,161 | 10/1991 | Whitacre . | |
| 5,107,642 | 4/1992 | Mogstad . | |

FOREIGN PATENT DOCUMENTS

| | | | |
|---|---|---|---|
| 628568 | 3/1963 | Belgium | 52/403.1 |
| 713745 | 7/1965 | Canada | 52/414 |
| 1186470 | 5/1985 | Canada . | |
| 50562 | 12/1975 | Finland . | |
| 2055959 | 11/1970 | Germany . | |
| 3325907 | 2/1985 | Germany . | |
| 3837564 | 5/1990 | Germany | 52/480 |
| 604808 | 5/1960 | Italy | 52/403.1 |
| 111836 | 11/1967 | Norway . | |
| 148041 | 8/1983 | Norway . | |
| 894899 | 12/1989 | Norway . | |
| 75143859 | 6/1967 | Sweden . | |
| 1122998 | 8/1968 | United Kingdom . | |
| 9304238 | 3/1993 | WIPO . | |

*Primary Examiner*—Carl D. Friedman
*Assistant Examiner*—Kevin D. Wilkens
*Attorney, Agent, or Firm*—Reed Smith Shaw & McClay

[57] ABSTRACT

An arrangement in a protective membrane (1; 101; 201), particularly for floors (11; 111; 211), comprising a substantially plane membrane of a preferably rigid material, e.g. plastic or similar, one side of the membrane (1A; 101A; 201A) having a large number of discrete protrusions or knobs (2A; 102A) preferably made by moulding, and the other side of the membrane (1B; 101B; 201B) having a corresponding number of indentations (2B; 102B; 202B) with substantially flat areas (4*n*; 104*n*) arranged among them and defining the main plane (3; 103) of the membrane, and for the purpose of providing a membrane which demonstrates good ergonometric properties when the floor is used, while at the same time the dampening of the noise of steps is optimized at the lowest possible level, it is suggested according to the invention that the arrangement comprise main area sectors (4*n*, 5*n*, 105*n*) and/or sectors with knobs (205*n*) which provide a combined yielding effect when subjected to loads and transfer of supporting capacity to other areas of the membrane (2BB; 102BB; 202BB).

10 Claims, 6 Drawing Sheets

ARRANGEMENT IN A PROTECTIVE MEMBRANE, ESPECIALLY FOR FLOORS

THE SCOPE OF THE INVENTION

The present invention relates to an arrangement in a protective membrane, especially for floors, comprising a substantially plane membrane of a comparatively rigid material, for instance plastic or similar, one side of the membrane having a large number of separated protrusions or knobs, preferably resulting from moulding, and the other side of the membrane having a corresponding number of indentations among which are arranged substantially flat areas which define the main plane of the membrane.

THE BACKGROUND OF THE INVENTION

The assignee through its developments within the field of protective membranes has provided several generations of the said types of membrane. A first generation of foundation wall membrane is known e.g. from U.S. Pat. No. 3,888,087 (Bergsland), while a second generation foundation wall membrane is described in NO patent 148 041, corresponding to CA 1 186 470 (Bergsland).

These protective membranes of first and second generations have mainly been used as foundation wall membranes applied as a cladding to the outer foundation wall of a house before back fill is placed next to it. Such foundation wall membranes are preferably manufactured with knobs which do not readily yield due to the outside forces from e.g. backfilling.

Recently it has also become usual for such foundation wall membranes to be used as a vapour barrier for slab-on-ground, and NO patent application 894899, corresponding to U.S. Pat. No. 5,107,642 (Mogstad) describes the use of such membranes for the protection of dwellings from penetration of fluids, especially unpleasant or noxious gases. Similar membranes are also described in assignee's U.S. Pat. No. 5,044,821 (Johnsen).

Available from the assignee are today systems based on the above mentioned protective membranes, particularly for protection from dampness of floors both with and without mechanical ventilation, and especially Norwegian patent application 89 4899 (U.S. Pat. No. 5,107,642) describes a so-called radon solution which preferably uses a protective membrane or a foundation wall membrane with knobs, manufactured in accordance with NO patent 148 041 (CA 1,186,470). (U.S. Pat. No. 3,888,087).

In connection with rehabilitation of basements and in connection with houses with no basements, built on a so-called slab-on-ground, there is a growing demand for a protective membrane on the concrete foundation which may provide the necessary protection, while at the same time constitute part of the assignee's system for mechanical ventilation. Also in connection with the construction of blocks of flats with floors at different levels, it is perhaps often relevant to have such protective membranes next to the untreated floor, especially if it has been levelled with a liquid smoother which emits noxious and/or unpleasant vapours.

In connection with those types of floor, both with regard to basement floors and floors at different levels in blocks of flats, there is, however, a user demand for a finished floor of good ergonomic properties, that is to say that the floor must be comfortable to walk on, and especially where floor dividers in apartment blocks are concerned, there is an increasing demand for particular sound insulating properties in such multi-purpose floors which may be made with or without mechanical ventilation.

PRIOR ART

FI 50 562 relates to a springy floor for sports, exhibition and similar purpose halls where, between a firm base and a floor layer, a springy membrane element is used, having a main plane from which protrusions are projecting in both directions, the individual rows of protrusions having been arranged as bonds or offset relative to each other, and the main plane of the membrane element is arranged so as to be eccentric between the knobs.

Known from DE 2.055.959 is a yielding floor for wet rooms, comprising a floor covering of rubber or plastic which in turn comprises upward directed bulges, while at the same time those areas in contact with the floor itself are secured to said floor by means of anchorage protrusions. This is a very special floor membrane where by definition there are no flat areas arranged between the bulges, but merely narrow transitional areas between the various bulges which are presumably inherently yielding.

DE 3 325 907 also relates to a building element of plastic being used in providing a double floor, comprising a carrier membrane with supporting elements filled with a floor filler. Although this is a matter of a sound-dampening device, very little is said about the floor supposedly yielding.

U.S. 3,888,087 (Bergsland) relates to the applicant's first generation protective membrane and gives no direction for the use of such membranes ! as intermediate floors, let alone a yielding intermediate floor.

GB 1.222.998 relates to a complex floor comprising a concrete slab 1, on which is arranged an insulation layer which in turn supports a yielding layer made up of corrugated sections of sheets made from hard resin, and a superimposed insulation layer with not quite so pronounced corrugations, as well as a superimposed layer which serves to distribute the pressure, and finally a floor covering on top of everything. The said corrugations are hardly comparable with the present protective membrane where there is a main plane, with knobs or indentations protruding from the main plane, while at the same time the main plane and/or the knobs are made with specifically arranged zone areas which provide for a particularly yielding effect.

NO 148.041 (Bergsland) relates to assignee's second generation of foundation wall membrane, which comprises crater-like knobs which do not serve a particularly yielding purpose, but rather provide additional support for a possible filter web.

SUMMARISING THE INVENTION

The present invention takes as its basis the task of providing a combination floor in which is used a protective membrane of the nature stated at the outset, which demonstrates ergonomic properties making the floor more comfortable to walk on.

Another objective of the present invention is in such a combination floor, to maintain the volume of air which previous membranes of this nature are able to show.

A further objective of the present invention is to describe a combination floor where the resonance of the sound waves in the volume of air in the protective membrane is optimized with a view to reducing the transmission of noise between floor dividers in multi-storey houses or blocks of flats.

Yet another objective of the present invention is to provide a combination floor in which it should be possible for it, after such a protective membrane has been placed on the untreated floor, to be supported by floor chippings, gyproc (plaster slab) or similar slabs or boards or parquet flooring, while at the same time the membrane is supposed to give a yielding effect or springy effect when the last mentioned is subjected to loads.

According to the invention these aims are achieved by an arrangement in a protective membrane of the nature mentioned initially which is, according to the invention, characterized in that the arrangement comprises main area zones and/or zones with knobs which provide a combined yielding effect when subjected to loads and a transmission of carrying capacity to other areas of the membrane.

A suitable way in which to provide this effect may according to the invention involve that the mainly flat areas which are arranged among the said indentations in the membrane, comprise or are made up of zones, extending from the main plane and yielding chiefly when subjected to loads. These zones may of course be designed in a number of different ways.

It may e.g. be possible to let the yielding zones comprise zone areas extending at an angle from the main plane and merging into pointed ends between the indentations, or it is possible to make protruding ribs in the otherwise flat areas among the indentations. On a membrane which abuts with its knobs against the untreated floor, the floor membranes may thereafter be placed on the said upwards extending pointed ends or rib-shaped protrusions which will provide suitable yield or springy action when the floor is subjected to loads.

Optionally, the yielding zones may comprise a multitude of individual bulges which are placed at random or incidentally in the area of the substantially flat areas among the cut-outs.

Alternatively, the invention may be realised in that, in the area of the knobs and/or in the knobs themselves, there are arranged areas which, when being subjected to loads, will constitute yielding zones.

Such zones with knobs may be designed in several different ways.

For instance, it has been suggested that the yielding zones are arranged in the root area of one or several knobs.

On a membrane which abuts on an untreated floor, with knobs facing downwards, floor slabs or the utility floor may be placed on the opposite, upper side of the protective membrane, which will provide the appropriate yielding or springy effect when the utility floor is being subjected to loads.

In particular when the protective membrane comprises frustum-conical, hollow knobs, it iS appropriate for the yielding zones to be arranged at the root area of each cone, preferably in the form of double-curved zones encircling the root.

In particular, the yielding zones should be designed in such a way as to retain a suitable volume of air in the membrane, while at the same time the resonance of sound waves in the volume of air should give rise to longer sound waves (lower pitch) than formerly known membranes, in order thereby to reduce the transmission of sound between storeys.

BRIEF DESCRIPTION OF THE FIGURES OF THE DRAWINGS

The invention will be described in the following with reference to exemplified embodiments, taken in conjunction with the attached drawings.

DETAILED DESCRIPTION OF THE EMBODIMENTS

Figure 1:
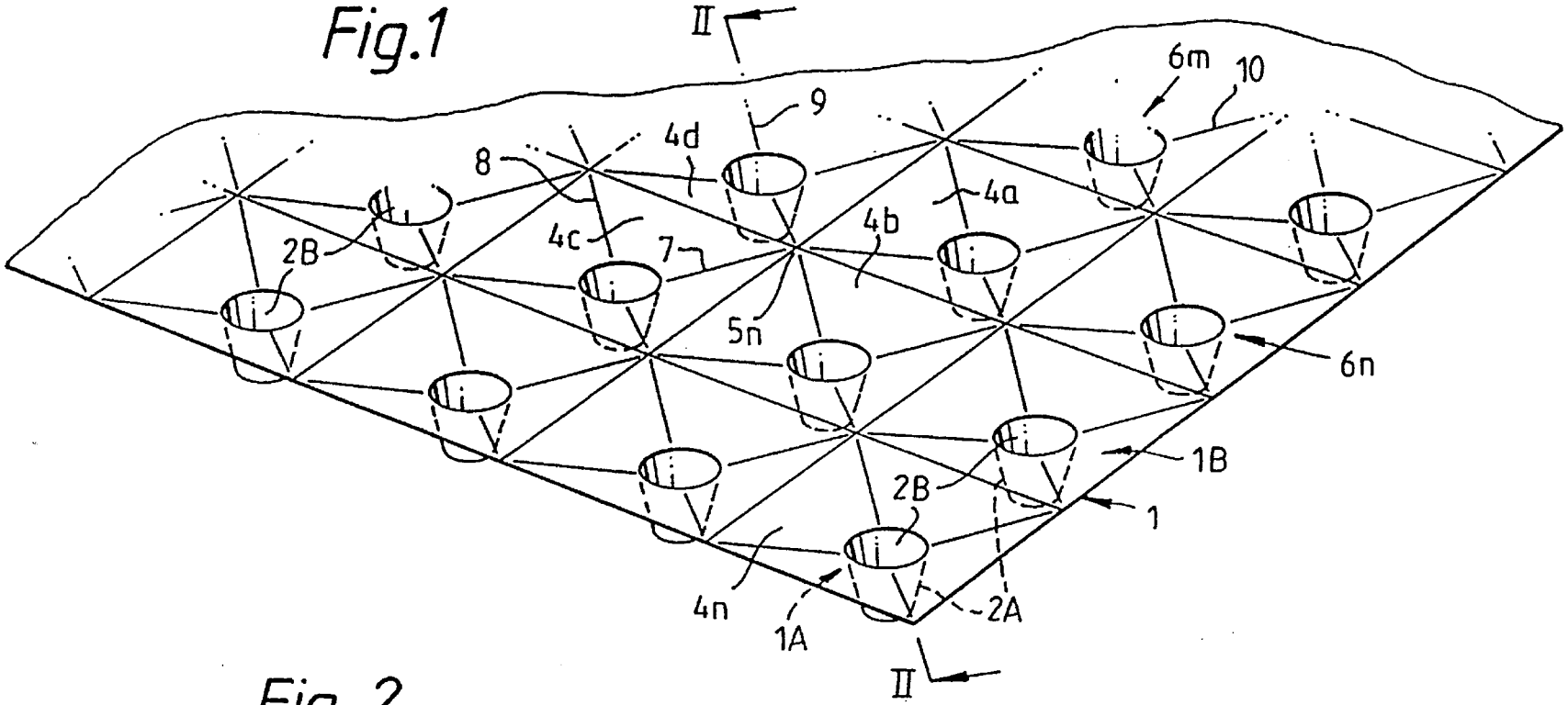
FIG. 1 is a perspective view of a section of an initial arrangement in a protective membrane according to the present invention.

In FIGS. 1–4 are illustrated, respectively, a perspective view, a cross section, and two detailed sectors of a protective membrane with pertaining details of a first arrangement in a protective membrane according to the invention. Here, the reference numeral 1 identifies the actual protective membrane, or a sector of the said membrane provided in continuous lengths. The membrane 1 may suitably be made from a comparatively rigid material, e.g. plastic, since this rigidity will entail that the membrane may be manufactured either as sheets of a standardized size, or as a continuous length in a roll.

Figure 2:
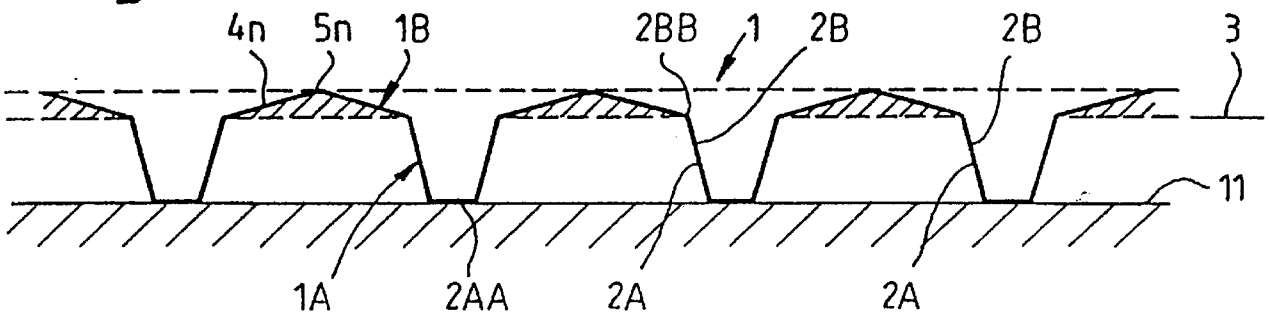
FIG. 2 is a cross section along the line II—II through the protective membrane shown in FIG. 1.

As will be evident from FIGS. 1 and 2, from one side of the membrane 1, and indeed the side 1A, a multitude of discrete protrusions or knobs 2A extends, preferably provided by means of moulding, a corresponding number of indentations 2B then being arranged on the other side 1B of the membrane, and among these knobs 2A and/or indentations 2B at the upper part 2BB of the indentations 2B, or correspondingly at the root area 2BB of the knobs 2A, a main plane 3 of the membrane 1 being defined. According to prior art, in previously known protective membranes as said, the areas **4*n* which lie between the indentations 2B** have been designed as substantially flat areas since it was desirable that the supporting surface be as large as possible relative either to the backfilling which would form a pressure against protective membranes used as foundation wall membranes, or for the superimposed utility floor in those instances where such membranes would be used as system floors, with or without mechanical ventilation.

According to the present invention, however, in order to resolve the tasks from which the present inventions takes its basis, in the embodiment shown in FIGS. 1–4, the said areas 4*n* have been designed in a general way so as to comprise or be made up of zones or protrusions extending from the main plane 3 and having a yielding effect substantially when subjected to loads.

In the embodiment shown in FIGS. 1–4, the yielding zones 4*n* comprise zone areas extending at an angle from the main plane 3, particular triangular surfaces 4*a*–4*d* with a shared common apex 5*n*.

Especially in a membrane 1 with a multitude of indentations 2B arranged in columns 6*m* and rows 6*n* at regular intervals, each of the substantially triangular surfaces 4*a*–4*d* has been arranged as curved or more or less interrupted along a line 7 from its base line 8 and to its apex or pointed end 5*n*. Each of the base lines 8 then continues through an indentation 2B and the apex of this triangle joins other triangles apexes at the intersection 5*n* for diagonals, respectively 9 and 10, through corresponding indentations 2A. Accordingly, adjacent yielding zones 4*n* may be arranged such that common surfaces of the yielding zones 4*n* may meet to form a common apex. As shown in FIG. 1, eight adjacent triangular surfaces meet along eight commonly shared side surfaces to form a common apex 5*n*.

Figure 3:
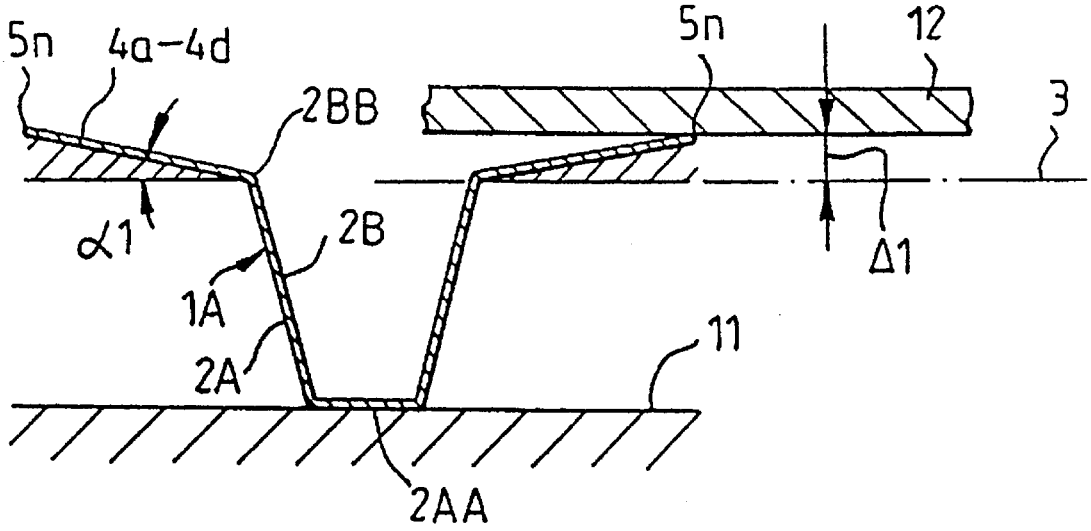
FIG. 3 shows on a larger scale a section through a cut-out of the membrane close to an indentation and with a superimposed utility floor not subjected to loads.

In FIG. 2 which shows a section through the membrane 1 in FIG. 1, and indeed along the line II—II, taken here along the diagonal 9 through the middle portions of the related indentations 2B, it will be seen that compared with what has been defined as the main plane 3 of the membrane, a multitude of pointed ends 5*n* appear among the knobs 2A or the corresponding indentations 2A. In the normal application of this type of protective membrane, the membrane 1 will be placed on a floor 11 with the side 2A with the knobs facing downwards towards the floor 11, meaning with the surface of the points 2AA resting against the said floor 11. In FIG. 3 which shows a sector of the section according to FIG. 2, a utility floor 12 is placed on top of the membrane 1, and when the floor 12 is not subjected to loads, the underside of the utility floor will rest on the said pointed ends 5*n*, and then at a distance Δ1 above the main plane 3 of the membrane.

Figure 4:
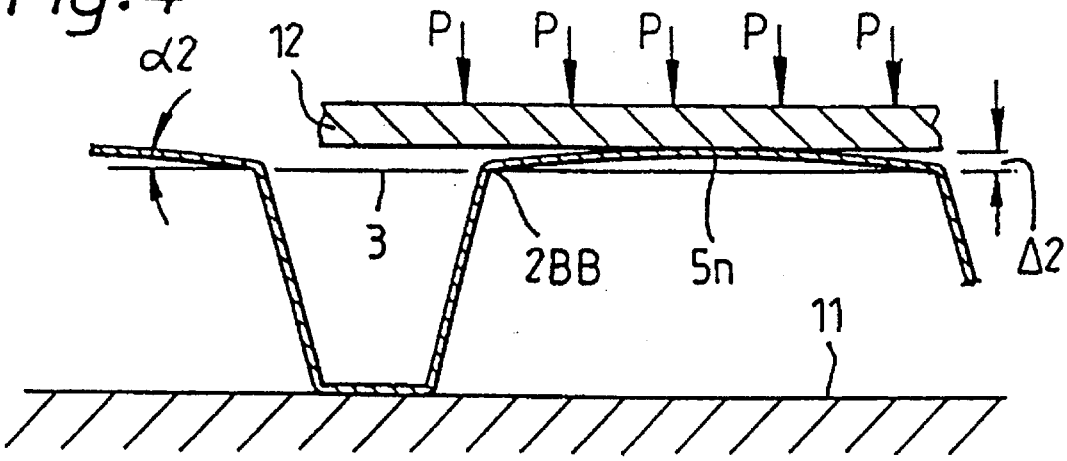
FIG. 4 is a section similar to FIG. 3, but showing the configuration of the section when the superimposed utility floor is subjected to loads.
Figure 5:
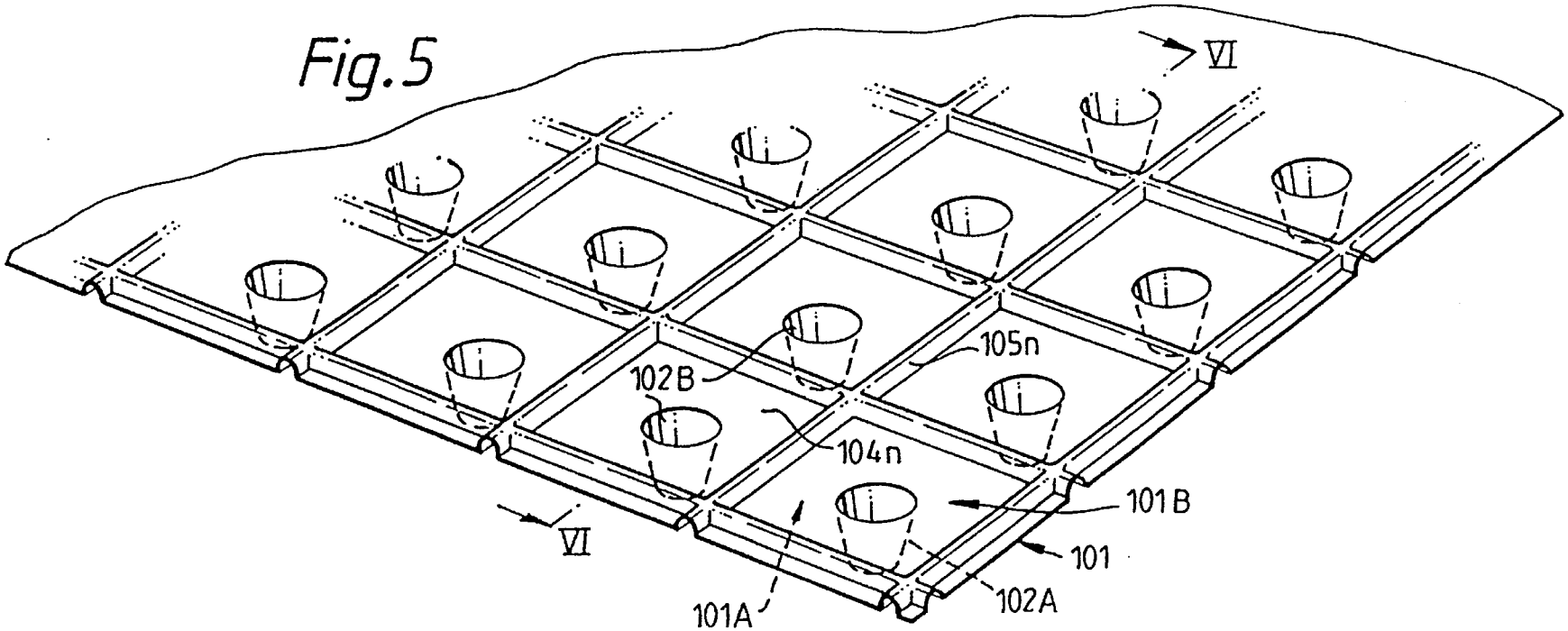
FIG. 5 is a perspective view of a second embodiment of an arrangement in a protective membrane according to the invention.

While the floor 12 is being used, that is when subjected to loads P as shown in FIG. 4, the protrusions of pointed ends 5*n* shown of the membrane 1 will provide a springy or yielding action which will be perceived as ergonomically comfortable for anybody using the floor, i.e. the points 5*n* will yield down to a second distance Δ2 above the main plane 3 of the membrane.

In a practical embodiment the membrane 1 may have been made with knobs 2A of a height of abt. 6 mm, which means that they extend 6 mm from the main plane 3 of the membrane, while the said protrusions or pointed ends 5*n* may extend for instance abt. 1 mm from the main plane 3 if the opposite direction of the knobs 2A. When not subjected to loads, as has been illustrated in FIG. 3, the points 5*n* will be in a position abt. 1 mm above the main plane 3, it being understood that the thickness and rigidity of the membrane as such has been adapted so that the utility floor 12 may be supported without any noticeable lowering of the points 5*n*. Then, in the state of not being subjected to loads, an angle α1 will result between the main plane 3 and the zone areas 4*a*–4*d* extending at an angle from the main plane 3, while, in a state of being subjected to loads, as is illustrated in FIG. 4, a considerably smaller angle α2 will result between the main plane 3 and the said points 5*n* affected in this connection, because of the yield or springy action to which the said extending zone areas 4*a*–4*d* which yield when being subjected to loads, give rise.

In FIGS. 5–8 which show a second embodiment of an arrangement in a protective membrane according to the invention, the membrane 101 has also here been made with protrusions or knobs 102A on one side of the membrane 101A, these protrusions defining corresponding indentations 102B in the other side 101B of the membrane, and, among the said indentations 102B or knobs 101A, substantially flat areas 104*n* being arranged which define the main plane 103 of the membrane.

In the embodiment shown in FIGS. 5–8, the substantially flat areas 104*n* have been made with yielding zones, comprising ribs 105*n* extending from the main plane 103 of the membrane, these in the present embodiment having been made in a pattern of squares in other embodiments also contemplated, or a random pattern of netting intersecting among the indentations 102B.

Figure 6:
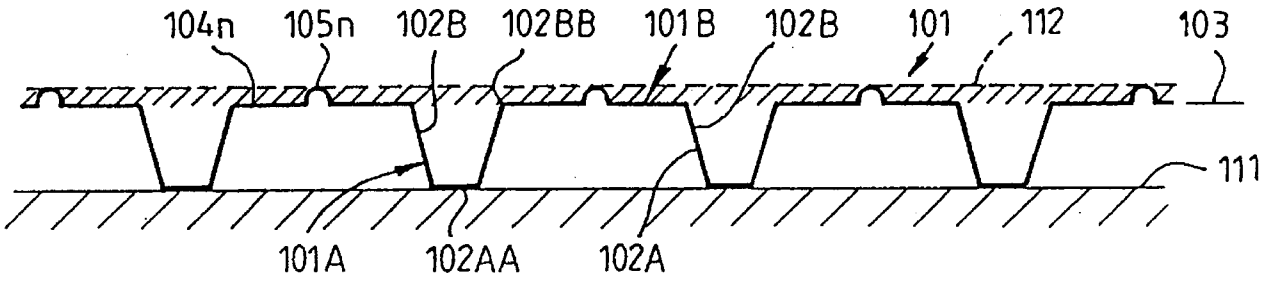
FIG. 6 is a cross section taken along the line IV—IV through the middle parts of the indentations in the membrane as shown in FIG. 5.
Figure 7:
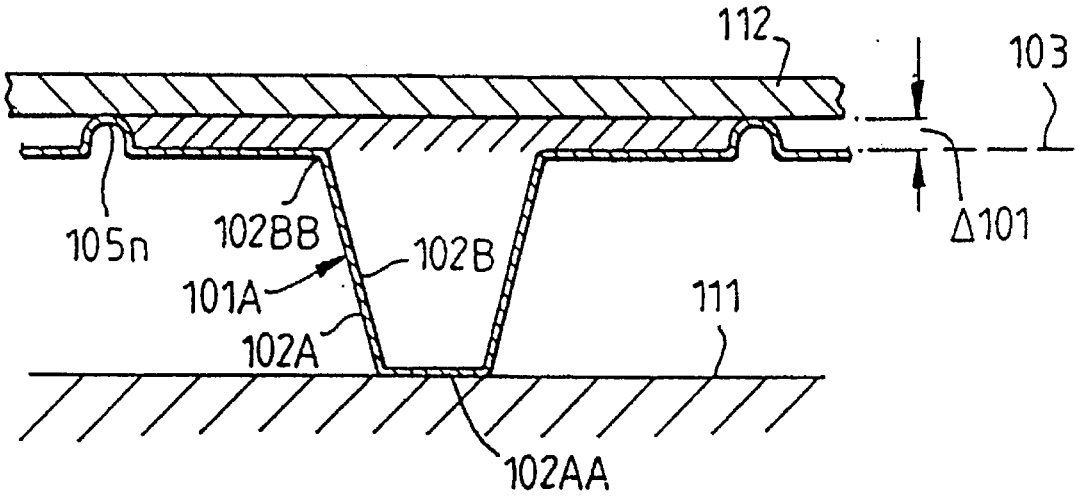
FIG. 7 shows on a larger scale a section through a cut-out of the protective membrane in the area of an indentation, and when the superimposed utility floor is not subjected to loads.

In FIGS. 6 and 7 is shown how the present membrane 101 has been placed on an untreated floor 111 with the upper areas 102AA of its knobs 102A resting against the floor, while it is shown in FIG. 7 that the membrane 101 on its ribs 105*n* extending in the opposite direction from the floor 111 supports a utility floor 122 not subjected to loads, and indeed a distance of Δ101 above the main plane 103 of the membrane.

Figure 8:
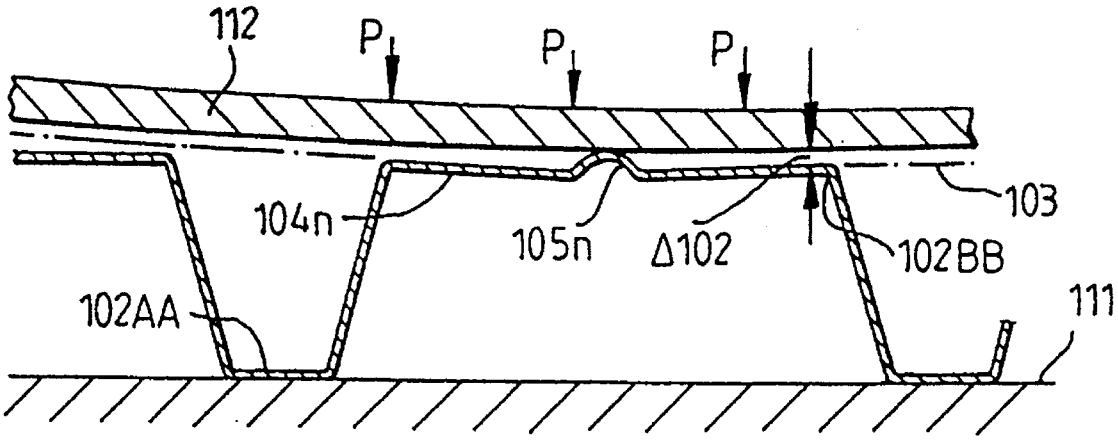
FIG. 8 shows a cut similar to FIG. 7, but showing the configuration of the membrane when the superimposed utility floor is subjected to loads.
Figure 9:
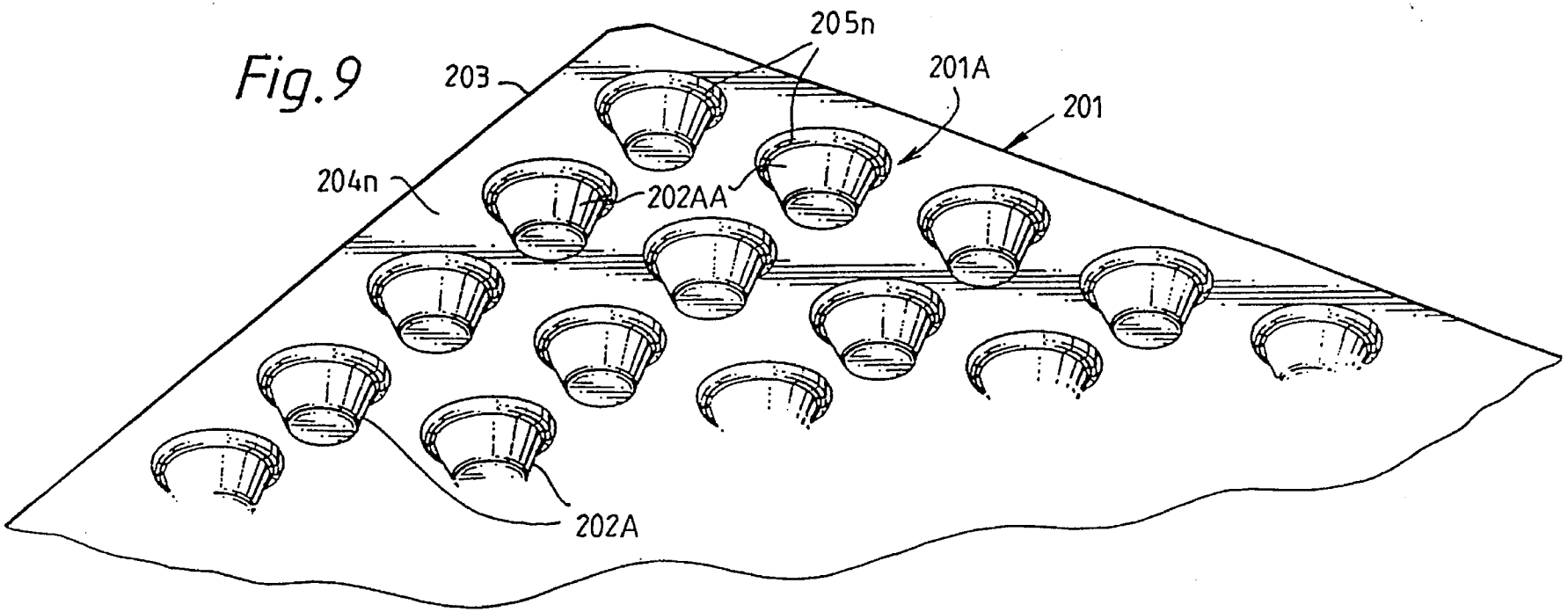
FIG. 9 is a perspective view of a cut-out of a third arrangement in a protective membrane according to the present invention.
Figure 10:
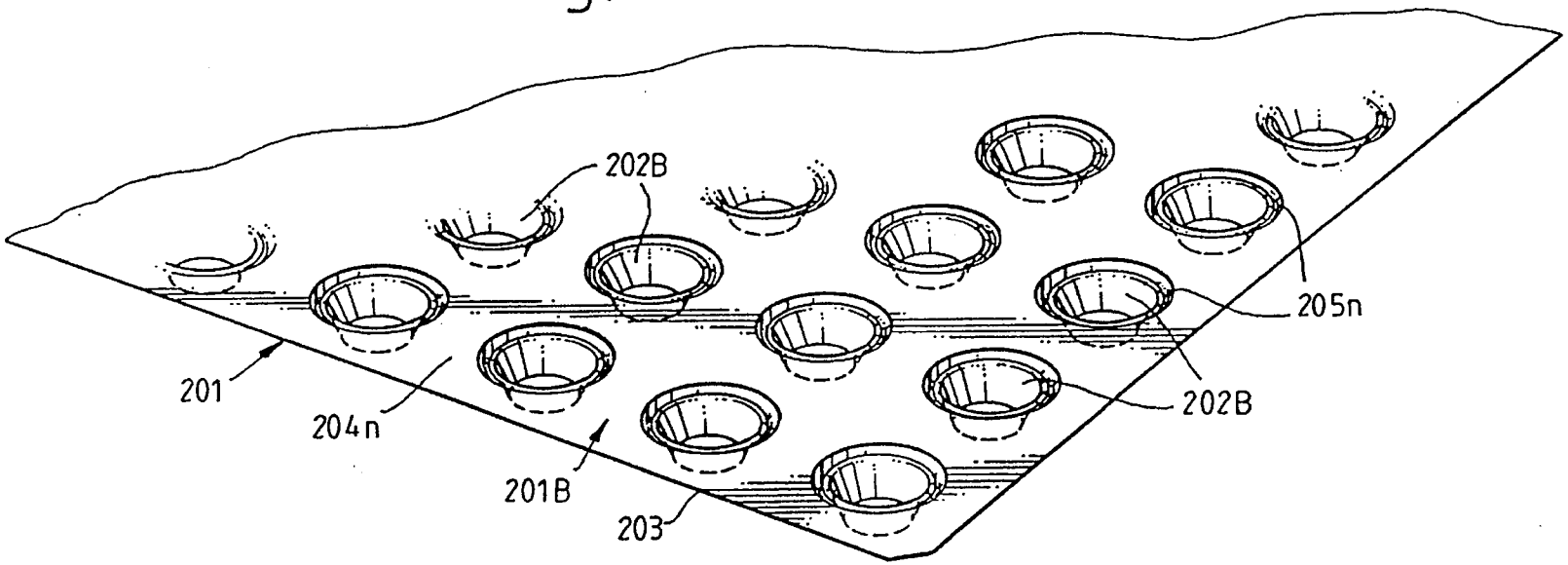
FIG. 10 is a perspective view similar to FIG. 9, showing the protective membrane viewed from the other side.

At the section shown in FIG. 8, the utility floor 12 has been subjected to a load P, and the yielding ribs 105*n*, together with the surrounding flat areas 104*n*, have then yielded or acted as springs down towards the level of the floor 111, shown here as a shorter distance Δ102 above the main plane 103 of the membrane, in order thereby to convey to the user of the floor a springy effect which makes the floor more comfortable to walk on.

Also in this embodiment the height of the knobs can preferably be abt. 6 mm, while the height of the ribs 105*n* may suitably be abt. 1 mm, but these dimensions may naturally be varied within wide ranges, depending on the yield or springy action desired when subjecting to loads the floor 112 which is placed on the membrane 101.

From the FIG. 9–12 will be seen a third embodiment of the present invention which concerns an arrangement in the protective membrane 201, especially for floor 211. Here, too, the membrane comprises a substantially level membrane 201 of a preferably rigid material, e.g. plastic or such like, one side 201A of the membrane having a large number of discrete protrusions or knobs 202A, preferably made by moulding, and the other side of the membrane 201B having a corresponding number of indentations 202B with substantially flat areas 204*n* arranged among them and defining the main plane 203 of the membrane. The membrane 201 is distinguished in that in the areas of the knobs 202A and/or in the knobs themselves, sectors 205*n* are arranged which, when being subjected to loads, will constitute yielding zones.

Figure 12:
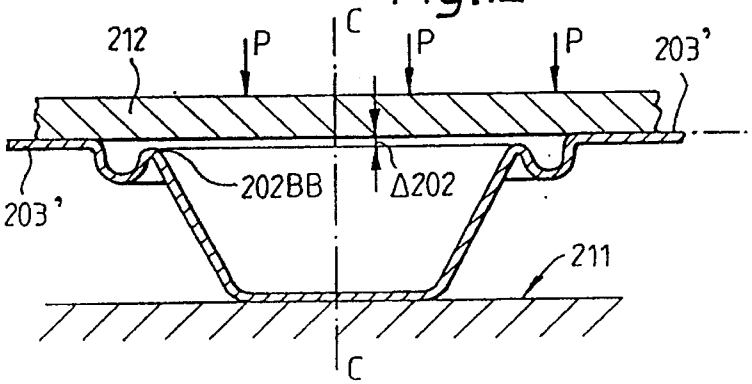
FIGS. 11 and 12 are on larger scales, sections through a smaller part of the protective membrane shown in FIGS. 9 and 10, placed on an underlying floor and below supporting floor slabs, in a condition, respectively, of not being and being subjected to loads.
Figure 11:
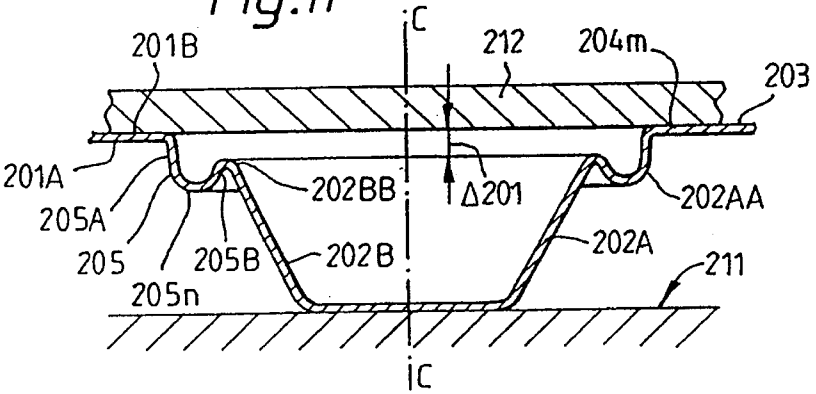

It is furthermore evident particularly from FIGS. 11 and 12 that the yielding zones 205*n* are arranged in the root area 202AA of one or several knobs 202A, that the yielding zones are arranged as at least one continuous part-torus or as convex sectors round the root area 202AA of one or several knobs 202A. More particularly, the yielding zones are arranged at the root area 202AA of each cone, preferably designed as double-curved zones 205 encircling the root, the root-encircling zones 205 comprising in cross-section an initial outer ring-shaped surface 205A extending beyond the main plane 203 of the membrane and continuing in a curved sector and thus curving inwards towards the centerline C of the knob concerned and into a surface 205B extending back towards the main plane and in turn curving towards and continuing into the upper edge 202BB of the actual indentation 202B, and then a dimension Δ201 from the main plane 203 without being subjected to loads, the said dimension being reduced to Δ202 or less when being subjected to the load P on the utility floor 212.

It should be understood that the area 205A extending beyond the main plane may pass across the upper edge of the indentation or in the root area of the knob 202A itself at a distance Δ201 from the main plane 203 via one or several additional suitable winding ring-shaped surfaces, e.g. in that parts of one or several knobs are designed with yielding sectors lying as bellows. Also in such embodiments, when subjecting the floor to loads, the result achieved will be that the supporting capacity of the membrane will be transferred to other surface areas, for instance down to the root edges 202BB, the main plane 203 of the membrane, see FIG. 11, descending via the position 203, see FIG. 12.

The yielding zones are also here adapted in such a way, particularly in relation to the design of the knobs, that the optimal dampening of steps is achieved when the membrane is placed between an untreated floor and a utility floor, particularly in providing resonance sound waves of longer wavelengths and lower pitch.

In the present invention special arrangements in protective membranes have thus been provided, and it should in particular be understood that the said yielding zones may also be varied within wide limits. For instance, the yielding zones may comprise a multitude of individual bulges, placed at random or incidentally in the area of the flat surfaces which lie among the said indentations 2B or 102B and/or comprise sectors of the actual indentations 202B.

It shall furthermore be understood that the membrane may be manufactured from many different materials, and a preferred plastic may be high density polyethylene of a density of minimum 950 kg/m$^2$ and a max. melt flow index of 0.3 g/10 minutes. Preferably, such a product may be resistant to UV decomposition, to alkalis and thermo oxidising decomposition. As an alternative to an all black membrane, for instance a membrane of a natural colour may be used, or a black membrane with a natural flap.

One advantage of a natural coloured membrane is that after the laying thereof, it is possible to check the seams in the best possible way while at the same time it may be possible to check whether the underlying concrete slab or untreated floor has been cleaned. In the event that a natural coloured membrane is used, the product should be UV stabilised in order to meet any specifications required by the building regulations in various countries.

Furthermore it shall be understood that the shape, the height, diameter and interpositioning of the knobs will need to be considered with regard to static and dynamic loads, and also the amount of air in the slits between the knobs, the flow pattern in mechanical ventilation as well as under-pressure in the said slits.

It should be understood that, in principle, any form of knobs may be used, meaning both simple knobs in the shape of a truncated round or multi-sided cone or in the form of round "double knobs". The height of the knobs and the shape of the knobs should be adapted in relation to the required volume of air and with a view to not causing a deterioration of the properties of corresponding membranes in terms of air noise insulation. At the same time the intention should be to design the knobs and their positions in such a way as to provide resonance for longer sound waves (lower pitch) than in knob shapes of the present nature since this will be of significance to the transmission of sound through floor dividers.

Ideally, the diameter/circumference of the cones should be as small as possible, and endeavors should be made to have the wall of the cone as straight as possible, but this should be evaluated against methods for manufacturing the membrane in a rational manner, particularly with regard to the possibility of moulding and not least the supporting capacity of the knobs as such. The knobs should preferably be placed in a symmetrical pattern so that they fit into each other when sideways mounting is carried out in the lengthwise and transverse directions. The intervals between knobs should be optimized and should be as large as possible all being calculated with account taken of the resistance to pressure, static and dynamic loads in the mounted state, and well as the load from transport on the membrane during mounting. The dimension and the shape of the knobs will moreover interact with the intervals between knobs where the capacity of the membrane to resist loads is concerned.

In the present invention, and as shown in the specific embodiments, and "ergonometric" protective membrane has been provided in which are arranged main area sectors and/or knob sectors which when being subjected to dynamic loads will allow themselves to be depressed, while yielding, down to a second level of the main plane of the membrane, so that at full yield in the elastic zones, the supporting capacity of the membrane will be transferred to other areas of the membrane.

When the load is removed from the floor, it shall be understood that the elastic areas return substantially to their main shape.

In the embodiments shown which show, respectively, rectangular protrusions in the areas between the root of the knob and rib-shaped protrusions which form a netting pattern, as well as knobs with yielding zones, it is shown in the various drawings how the depressed area varies between a floor not subjected to loads and one which is subjected to loads. It shall be understood that this depressed area may of course be varied, depending on the dimensions chosen which should naturally be optimized according to prevailing conditions and the terms and requirements stipulated.

The present arrangement in a protective membrane thus describes a solution which to a considerable degree improve the ergonometric properties in utility floors while at the same time an optimization is achieved of the transmission of sound through floors incorporating the said protective membranes according to the invention.

I claim:

1. A protective membrane for floors comprising a substantially planar membrane of substantially rigid material, said membrane having top and bottom surfaces; said bottom surface having a plurality of protrusions, wherein each of said protrusions has a root area between said top and bottom surfaces and substantially adjacent to said protrusion; and said top surface having a number of indentations corresponding to said protrusions wherein one or more of said protrusions each have a yielding zone which combines with said top and bottom surfaces to produce a yielding and a load dissipation effect when said membrane is subjected to a load, wherein each of said yielding zones are substantially adjacent to said root area and comprise substantially triangular surfaces which extend at an angle from a reference plane, wherein said reference plane extends substantially through said membrane at substantially each of said root areas, and wherein said triangular surfaces are arranged to form a plurality of common apexes.

2. The membrane of claim 1, wherein said indentations are arranged in columns and rows.

3. A protective membrane for floors comprising a substantially planar membrane of substantially rigid material, said membrane having top and bottom surfaces and a reference plane which substantially coincides with said top surface of said membrane; said bottom surface having a plurality of protrusions, wherein each of said protrusions has a root area between said top and bottom surfaces and substantially adjacent to said protrusion; and said top surface having a number of indentations corresponding to said protrusions, wherein one or more of said protrusions have a yielding zone which combines with said top and bottom surfaces to produce a yielding and load dissipation effect when said membrane is subjected to a load; wherein each of said yielding zones are substantially adjacent to said root area, said yielding zone having a one-part cavity encircling said root area, said cavity being substantially defined by inner and outer side surfaces adjoined by a bottom surface, said outer surface also being adjoined to said membrane to form an outer edge of said cavity and said inner surface being adjoined to said protrusion to form an inner edge of said cavity, said inner edge being positioned at a distance from said reference plane and said outer edge being positioned at a lesser distance from said reference plane than said distance of said inner edge.

4. The membrane of claim 3, wherein said cavity comprises a trough.

5. The membrane of claim 3, wherein said cavity comprises a torus.

6. A protective membrane for floors comprising a substantially planar membrane of substantially rigid material, said membrane having top and bottom surfaces and a reference plane which substantially coincides with said top surface of said membrane; said bottom surface having a plurality of protrusions, wherein each of said protrusions has a root area between said top and bottom surfaces and substantially adjacent to said protrusion; and said top surface having a number of indentations corresponding to said protrusions, wherein one or more of said protrusions each have a yielding zone which combines with said top and bottom surfaces to produce a yielding and load dissipation effect when said membrane is subjected to a load, and wherein each of said yielding zones are substantially adjacent to said root area, said yielding zone having a cavity, said cavity substantially defined by curved areas adjacent to said root area, said curved areas comprising inner and outer curved areas, said inner curved area being adjoined to said protrusion and having a top surface positioned at a distance from said reference plane, and said outer curved area being adjoined to said inner curved area and said outer curved area also being adjoined to said membrane to form an outer edge wherein said outer edge is positioned at a lesser distance from said reference plane than said distance of said top surface of said inner curved area.

7. The membrane of claim 6, wherein said yielding zone comprises a bellows.

8. The membrane of claim 6, wherein said outer curved area extends beyond said reference plane and curves inward towards a centerline of said protusion and into said inner curved area wherein said inner curved area extends back towards said reference plane and curves toward said root area at a distance from said reference plane.

9. The membrane of claim 8, wherein said curved areas further comprise a ring-shaped surface.

10. The membrane of claim 8, wherein said curved areas further comprise more than one ring-shaped surface.

* * * * *